US006332394B1

(12) United States Patent
Kato et al.

(10) Patent No.: US 6,332,394 B1
(45) Date of Patent: Dec. 25, 2001

(54) PISTON FOR SWASH PLATE TYPE COMPRESSOR, WHEREIN HEAD PORTION INCLUDES RADIALLY INNER SLIDING PROJECTION CONNECTED TO NECK PORTION

(75) Inventors: Takayuki Kato; Seiji Katayama; Shigeo Fukushima; Masato Takamatsu; Fuminobu Enokijima, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/593,015

(22) Filed: Jun. 13, 2000

(30) Foreign Application Priority Data

Jun. 15, 1999 (JP) ..... 11-168591

(51) Int. Cl.[7] ..... F01B 31/10; F01B 3/00
(52) U.S. Cl. ..... 92/71; 92/159; 92/172
(58) Field of Search ..... 92/71, 159, 160, 92/172

(56) References Cited

U.S. PATENT DOCUMENTS

| | | | | |
|---|---|---|---|---|
| 5,174,728 | * | 12/1992 | Kimura et al. | 92/71 X |
| 5,382,139 | | 1/1995 | Kawaguchi et al . | |
| 5,630,353 | * | 5/1997 | Mittlefehldt et al. | 92/71 |
| 5,706,716 | * | 1/1998 | Umemura | 92/71 X |
| 5,765,464 | * | 6/1998 | Morita | 92/172 X |
| 5,816,134 | * | 10/1998 | Takenaka et al. | 92/159 X |
| 5,868,556 | * | 2/1999 | Umemura | 92/71 X |
| 5,899,135 | * | 5/1999 | Kanou et al. | 92/172 X |
| 5,953,980 | * | 9/1999 | Ota et al. | 92/172 X |
| 6,024,009 | * | 2/2000 | Morita | 92/155 X |
| 6,216,584 | * | 4/2001 | Terauchi | 92/160 |

FOREIGN PATENT DOCUMENTS

| | | |
|---|---|---|
| 0 809 024 A1 | 11/1997 | (EP) . |
| 0 809 025 A1 | 11/1997 | (EP) . |
| 6-336977 | 6/1994 | (JP) . |
| 9-203378 | 8/1997 | (JP) . |
| 9-250451 | 9/1997 | (JP) . |
| WO96/39581 | 9/1997 | (JP) . |
| 11-107912 | 4/1999 | (JP) . |

* cited by examiner

*Primary Examiner*—John E. Ryznic
(74) *Attorney, Agent, or Firm*—Morgan & Finnegan, LLP

(57) ABSTRACT

A piston for a swash plate type compressor, including a head portion slidably fitted in a cylinder bore in a cylinder block of the compressor, a neck portion slidably engaging a swash plate of the compressor, and a connecting portion connecting the head and neck portions, wherein the head portion comprises a circular body portion, and an inner sliding projection extending toward the neck portion from a radially inner circumferential part of the body portion which corresponds to a radially inner portion of the cylinder block. The inner sliding projection has a sliding surface for sliding contact with an inner circumferential surface of the cylinder bore. The sliding surface is symmetrical with respect to a plane including centerlines of the piston and the cylinder block. The connecting portion connects the inner sliding projection and the neck portion.

7 Claims, 4 Drawing Sheets

PISTON FOR SWASH PLATE TYPE COMPRESSOR, WHEREIN HEAD PORTION INCLUDES RADIALLY INNER SLIDING PROJECTION CONNECTED TO NECK PORTION

This application is based on Japanese Patent Application Nos. 11-168591 and 11-185638 filed Jun. 15 and Jun. 30, 1999, respectively, the contents of which are incorporated hereinto by reference.

BACKGROUND OF THE INVENTION

1. Field of the Invention

The present invention relates to a piston used for a swash plate type compressor.

2. Discussion of the Related Art

As a piston for a swash plate type compressor, there are known various types of pistons each of which has (a) a head portion which is slidably fitted in a cylinder bore formed in a cylinder block, (b) a neck portion which engages a swash plate, and (c) a connecting portion which connects the head portion and the neck portion. An example of such pistons is disclosed in JP-A-9-203378. In the swash plate type compressor piston disclosed in this publication, the head portion has a through-hole formed therethrough in a direction substantially parallel to the circumferential direction of the cylinder block, and the head portion and the neck portion are connected to each other at two circumferential portions of the cylinder bore which correspond to respective radially inner and outer portions of the cylinder block. The through-hole formed in the head portion contributes to a reduction in the weight of the piston.

SUMMARY OF THE INVENTION

It is an object of the present invention to minimize the weight of a piston used for a swash plate type compressor. This object may be achieved by a piston for a swash plate type compressor, which is constructed according to any one of the following forms or modes of the present invention, each of which is numbered like the appended claims and depends from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A piston for a swash plate type compressor, including a head portion slidably fitted in a cylinder bore formed in a cylinder block of the compressor, a neck portion slidably engaging a swash plate of the compressor, and a connecting portion connecting the head and neck portions, wherein the head portion comprises a body portion having a circular shape in cross section, and an inner sliding projection extending toward the neck portion from a radially inner circumferential part of the body portion which corresponds to a radially inner portion of the cylinder block, the inner sliding projection having a sliding surface for sliding contact with an inner circumferential surface of the cylinder bore, the sliding surface being symmetrical with respect to a plane including a centerline of the piston and a centerline of the cylinder block, the connecting portion connecting the inner sliding projection and the neck portion, at the radially inner circumferential part of the body portion, and not connecting the head portion and the neck portion at a radially outer circumferential part of the body portion which corresponds to a radially outer portion of the cylinder block.

In the piston for a swash plate type compressor, which is constructed according to the above form (1) of this invention, the connecting portion connects the head portion and the neck portion at the radially inner circumferential part of the body portion, but does not connect the head and neck portions at the radially outer circumferential part of the body portion. This arrangement permits a smaller weight of the piston than the arrangement wherein the head and neck portions are connected at both of the radially inner and outer circumferential parts of the body portion which correspond to the respective radially inner and outer portions of the cylinder block. From the standpoint of the strength of the piston, the connection of the head and neck portions at both of the radially inner and outer circumferential parts of the body portion of the head portion is not essential, and the head and neck portions are connected to each other by the connecting portion only at the radially inner circumferential part of the body portion. In the absence of a connecting portion at the radially outer circumferential portion of the body portion, it may be necessary to increase the weight of the connecting portion extending from the radially inner circumferential portion of the body portion, for increasing the strength of the connecting portion. However, the weight of the piston can be generally made smaller in the above form (1) of the invention than where the head and neck portions are connected at both of the radially inner and outer circumferential parts of the body portion (head portion). Where the piston is formed by casting or forging, the configuration and dimensions of the connecting portion are determined not only by the required strength of the piston, but also depending upon the casting or forging technique used. In this respect, the elimination of the connecting portion at the radially outer circumferential part of the head portion does not necessarily require an increase in the strength of the connecting portion at the radially inner circumferential part of the head portion, and provides a reduction in the weight of the piston in most cases.

Further, the sliding surface of the inner sliding projection is symmetrical with respect to the plane including the centerlines of the piston and cylinder block. This arrangement permits the inner sliding projection to receive a reaction force due to a side force generated by the swash plate from the inner circumferential surface of the cylinder bore, from the inner circumferential surface of the cylinder bore, over a sufficiently large area of the sliding surface, irrespective of the direction of rotation of the swash plate. Accordingly, the present arrangement is effective to minimize a local wear of the surface of the cylinder bore and the sliding surface of the inner sliding projection. It is known that the point of action of the reaction force received from the cylinder bore is located on the leading side of the plane including the centerlines of the piston and cylinder block, as seen in the direction of rotation of the swash plate. Accordingly, the weight of the piston could be reduced and its local wear could be minimized, if the weight of the inner sliding projection were made relatively large on the leading side of the plane, and relatively small on the trailing side. However, this arrangement permits the use of the piston for only the swash plate type compressor of the type in which the swash plate is always rotated in the predetermined one direction (clockwise or counterclockwise direction). The piston according to the present invention wherein the inner sliding projection is symmetrical with respect to the above-indicated plane can be used irrespective of whether the swash plate is rotated in the clockwise or counterclockwise direction.

(2) A piston according to the above form (1), wherein at least one of a first inner surface of the inner sliding projection which faces in a radially outward direction of the cylinder block and a second inner surface of the body portion which faces toward the neck portion has at least one recess formed therein.

In the piston according to the above form (2) of this invention, at least one recess is formed in at least one of the first and second surfaces indicated above, so that the weight of the piston is accordingly reduced. It is desirable that the at least one recess be formed symmetrically with respect to the plane including the centerlines of the piston and the cylinder block. The term "recess" used herein is interpreted to mean either or both of a through-hole formed through the inner sliding projection, and a recess or blind hole not formed through the inner sliding projection. Where the recess is formed in the circular body portion of the head portion, the recess must not extend through the entire thickness of the body portion.

Since the head and neck portions are not connected to each other by the connecting portion at the radially outer circumferential part of the body portion, as described above with respect to the above form (1), there is left an opening between the head and neck portions, at the radially outer circumferential part of the body portion. When each recess is formed by a cutting tool, the first or second inner surface indicated above can be easily accessed through the opening. For instance, the piston is first produced by casting such that the head and neck portions are not connected to each other by the connecting portion on the radially outer side of the cylinder block, so that the cutting tool used for forming the recess is positioned to extend through the above-indicated opening to perform a cutting operation on the above-indicated first or second inner surface. Further, a slide core used for forming the recess during casting of the piston can be set in a casting mold through an opening of the mold which corresponds to the opening to be formed in the piston by casting.

(3) A piston according to the above form (2), wherein the above-indicated at least one recess includes at least one recess open in the sliding surface of the inner sliding projection.

The at least one recess which is open in the inner sliding projection is effective to further reduce the weight of the piston. This recess will be described in detail with respect to the following form (5) of the invention. The present form (3) and the following form (4) are also applicable to a piston wherein the connecting portion connects the neck portion to both of the inner sliding projection indicated above and an outer sliding projection which projects from a radially outer circumferential part of the body portion of the head portion which corresponds to a radially outer portion of the cylinder block.

(4) A piston according to any one of the above forms (1)–(3), wherein the head portion comprises at least one of (a) an outer sliding projection extending toward the neck portion from a radially outer circumferential part of the body portion which corresponds to a radially outer portion of the cylinder block, the outer sliding projection having a sliding surface for sliding contact with the inner circumferential surface of the cylinder bore, and (b) a wall extending in a direction which intersects a circumferential direction of the body portion.

The outer sliding projection provided on the head portion is effective to minimize a local wear of the sliding surface of the head portion at a circumferential part thereof corresponding to the radially outer portion of the cylinder block. The wall provided on the head portion is effective to strengthen the head portion. Where the outer sliding projection is provided, at least one recess may be formed in an inner surface of the outer sliding projection which faces in the radially inward direction of the cylinder block, namely, toward the inner sliding projection. The wall is preferably formed so as to connect the inner and outer sliding projections of the head portion.

(5) A piston for a swash plate type compressor, including a head portion slidably fitted in a cylinder bore formed in a cylinder block of the compressor, a neck portion slidably engaging a swash plate of the compressor, and a connecting portion connecting the head and neck portions, wherein the head portion comprises a body portion having a circular shape in cross section, and an inner sliding projection extending toward the neck portion from a radially inner circumferential part of the body portion which corresponds to a radially inner portion of the cylinder block, the inner sliding projection having a sliding surface for sliding contact with an inner circumferential surface of the cylinder bore, the inner sliding projection having at least one recess open in the sliding surface.

The at least one recess formed in the sliding surface of the inner sliding projection is effective to reduce the weight of the piston. The piston does not suffer from a problem with the fluid tightness between the piston and the cylinder bore, even in the presence of the at least one recess open in the sliding surface of the projection, since the fluid tightness is provided between the body portion of the head portion and the inner circumferential surface of the cylinder bore. In this sense, the body portion can be considered to be a sealing portion.

The at least one recess may be located at any part of the sliding surface of the inner sliding projection. However, the at least one recess is preferably located at a part at which the reaction force received from the cylinder bore is not so large. The reaction force is relatively large at the end portion of the inner sliding projection on the side of the neck portion, and at the circumferential portion of the projection which is on the leading side of the plane including the centerlines of the piston and cylinder block, as seen in the rotating direction of the swash plate. In this respect, the at least one recess is preferably located at a portion of the projection other than the above-indicated portion at which the reaction force is relatively large.

As described above with respect to the above form (2), the term "recess" is interpreted to mean either or both of a through-hole formed through the inner sliding projection, and a recess or blind hole not formed through the inner sliding projection. Each recess may be circular or elongate in one direction, in cross section. Where the recess is elongate in one direction, it may be elongate in a direction parallel to the centerline of the piston, or in the circumferential direction of the head portion. In either case, it is easier to form the recess in the sliding surface of the inner sliding projection on the radially inner side of the cylinder block, than in the inner surface of the projection which faces in the radially outward direction of the cylinder block, as described above with respect to the above form (2).

The inner sliding projection in the present piston may be either symmetrical or asymmetrical with respect to the above-identified plane. The piston according to the above form (5) may incorporate any one of the technical features of the pistons according to the above forms (1)–(4). Where the head portion further comprises an outer sliding projection as described above with respect to the above form (4), at least one recess may be formed on a sliding surface of the outer sliding projection which slidably contacts the inner circumferential surface of the cylinder block. The connecting portion may include at least one of an inner connecting part connecting the inner sliding projection and the neck portion, and an outer connecting part connecting the outer sliding projection and the neck portion. Where at least one recess is formed in the sliding surface of the inner sliding projection, the outer connecting part may be provided.

(6) A swash plate type compressor comprising:

a cylinder block having a plurality of cylinder bores arranged along a circle;

a rotary drive shaft having an axis aligned with a centerline of the circle;

a swash plate rotated by the drive shaft; and a piston including a head portion slidably fitted in each of the cylinder bores, a neck portion slidably engaging the swash plate, and a connecting portion connecting the head and neck portions, the piston being reciprocated by rotation of the swash plate by the drive shaft, the head portion comprising a body portion having a circular shape in cross section, and an inner sliding projection extending toward the neck portion from a radially inner circumferential part of the body portion which corresponds to a radially inner portion of the cylinder block, the inner sliding projection having a sliding surface for sliding contact with an inner circumferential surface of the cylinder bore, the sliding surface being symmetrical with respect to a plane including a centerline of the piston and a centerline of the cylinder block, the connecting portion connecting the inner sliding projection and the neck portion, at the radially inner circumferential part of the body portion, and not connecting the head portion and the neck portion at a radially outer circumferential part of the body portion which corresponds to a radially outer portion of the cylinder block.

The piston of the compressor according to the above form (6) of this invention may include any one of the technical features of the above forms (2)–(5).

(7) A swash plate type compressor comprising:

a cylinder block having a plurality of cylinder bores arranged along a circle;

a rotary drive shaft having an axis aligned with a centerline of the circle;

a swash plate rotated by the drive shaft; and a piston including a head portion slidably fitted in each of the cylinder bores, a neck portion slidably engaging the swash plate, and a connecting portion connecting the head and neck portions, the piston being reciprocated by rotation of the swash plate by the drive shaft, the head portion comprises a body portion having a circular shape in cross section, and an inner sliding projection extending toward the neck portion from a radially inner circumferential part of the body portion which corresponds to a radially inner portion of the cylinder block, the inner sliding projection having a sliding surface for sliding contact with an inner circumferential surface of the cylinder bore, the inner sliding projection having at least one recess open in the sliding surface.

The piston of the compressor according to the above form (7) of this invention may include any one of the technical features of the above forms (1)–(4).

BRIEF DESCRIPTION OF THE DRAWINGS

The above and optional objects, features, advantages and technical and industrial significance of this invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Figure 1:
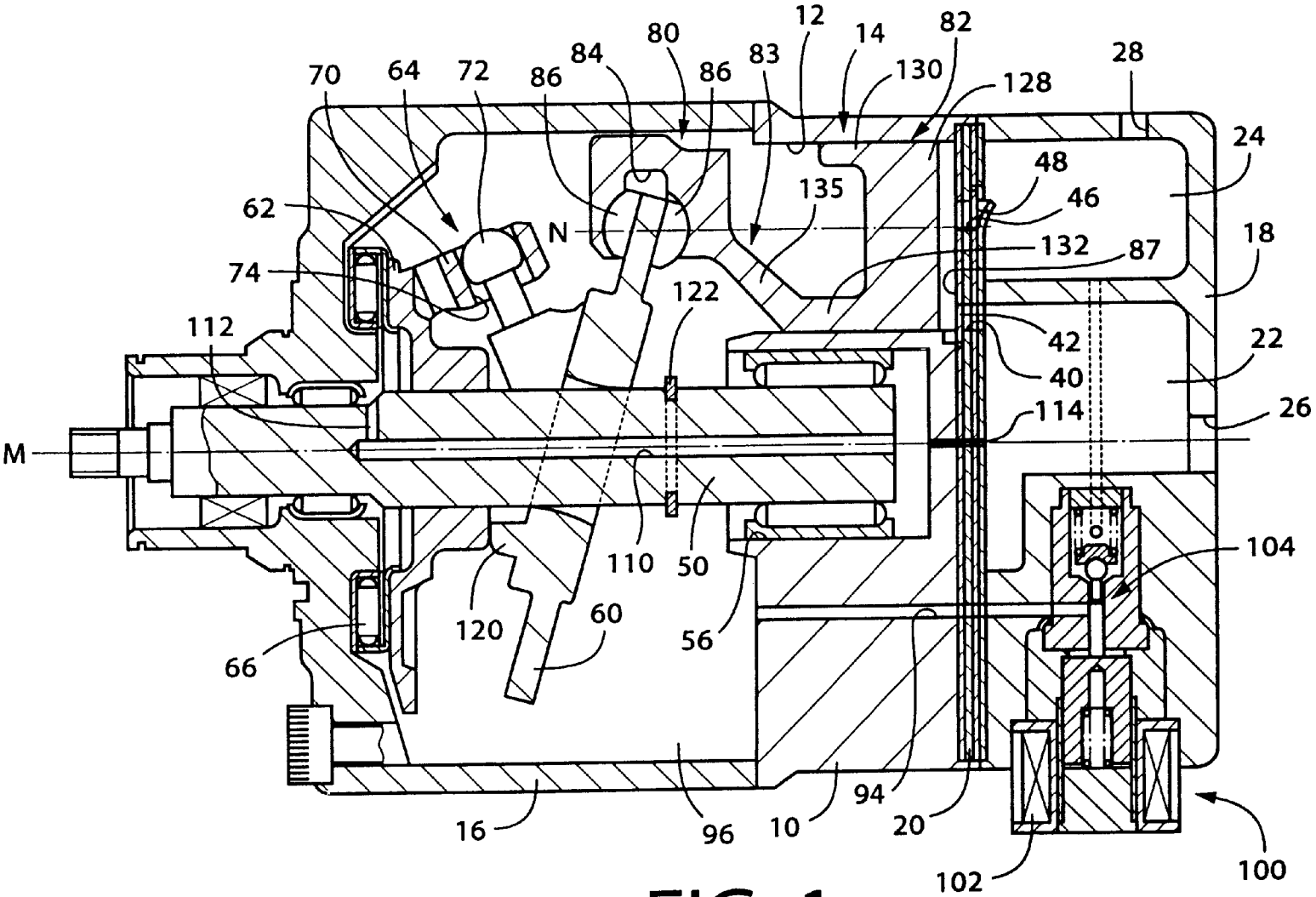
FIG. 1 is a front elevational view in cross section of a swash plate type compressor incorporating a piston constructed according to one embodiment of this invention.
Figure 2:
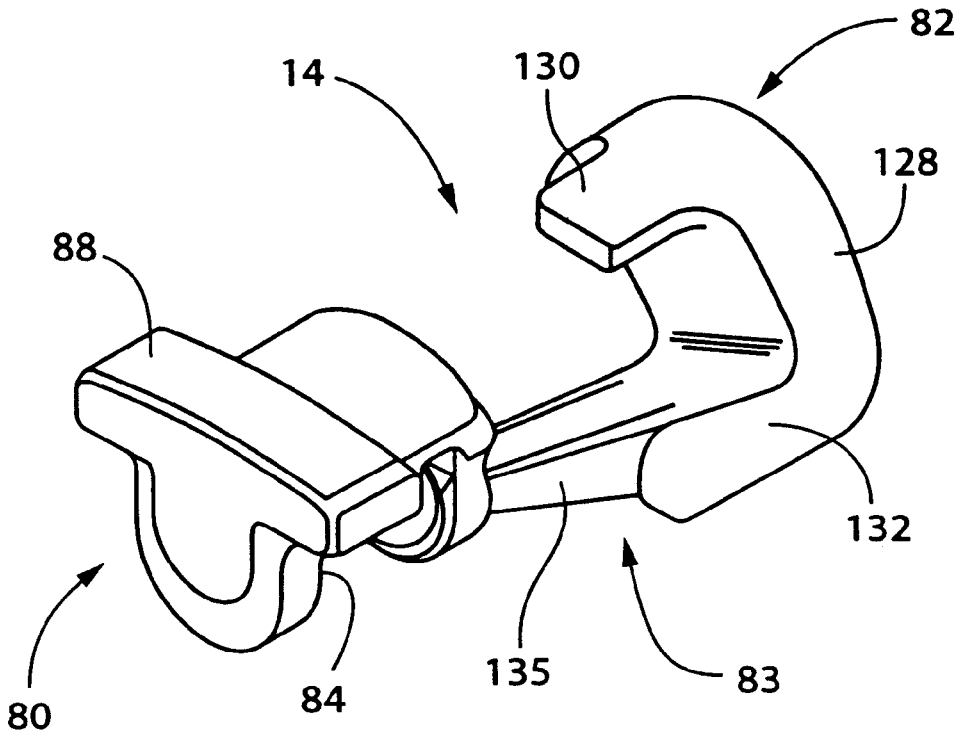
FIG. 2 is a perspective view showing the piston of FIG. 1.
Figure 3:
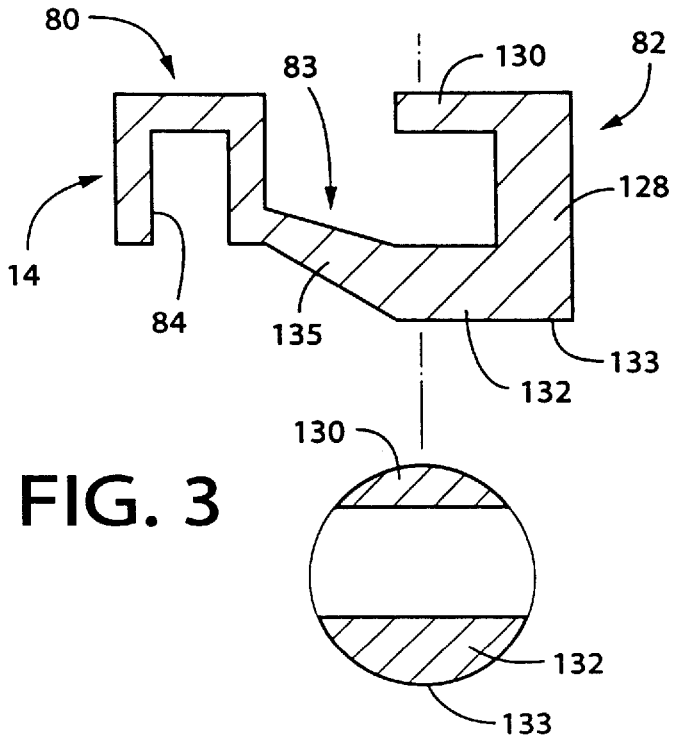
FIG. 3 is a cross sectional view of the piston of FIG. 1.

Referring to FIGS. 1–3, there will be described a piston for a swash plate type compressor, which is constructed according to the first embodiment of the present invention. FIG. 1 shows the swash plate type compressor incorporating a plurality of pistons.

In FIG. 1, reference numeral 10 denotes a cylinder block having a centerline M and a plurality of cylinder bores 12 formed so as to extend in its axial direction such that the cylinder bores are arranged along a circle whose center lies on the centerline M. The piston generally indicated at 14 is reciprocably received in each of the cylinder bores 12. To one of the axially opposite end faces (the right end face as seen in FIG. 1, which will be referred to as "front end face"), there is attached a front housing 16. To the other end face (the left end face as seen in FIG. 1, which will be referred to as "rear end face"), there is attached a rear housing 18 through a valve plate structure 20. The front housing 16, rear housing 18 and cylinder block 10 cooperate to constitute a major portion of the body of the swash plate type compressor.

The rear housing 18 and the valve plate 20 cooperate to define a suction chamber 22 and a discharge chamber 24, which are connected to a refrigerating circuit (not shown) through an inlet 26 and an outlet 28, respectively. The valve plate structure 20 has a suction ports 40, suction valves 42, discharge ports 46 and discharge valves 48.

A rotary drive shaft 50 is disposed in the cylinder block 10 and the front housing 16 such that the axis rotation of the drive shaft 50 is aligned with the centerline M of the cylinder block 10. The drive shaft 50 are supported at its opposite end portions by the front housing 16 and the cylinder block 10 via respective bearings. The cylinder block 10 has a central bearing hole 56 formed in a central portion thereof, and the bearing is disposed in this central bearing hole, for supporting the drive shaft 50 at its rear end portion.

The rotary drive shaft 50 carries a swash plate 60 mounted thereon such that the swash plate 60 is axially movable and tiltable relative to the drive shaft 50. To the drive shaft 50, there is fixed a lug plate 62 which is held in engagement with the swash plate 60 through a hinge mechanism 64. The lug plate 62 is rotatable with the drive shaft 50 relative to the front housing 16 through a thrust bearing 66. The hinge mechanism 64 causes the swash plate 60 to be rotated with the drive shaft 50 during rotation of the drive shaft 50, and guides the swash plate 60 for its axial and tilting motions.

The hinge mechanism 64 includes a pair of support arms 70 fixed to the lug plate 62, and guide pins 72 formed on the swash plate 60. The guide pins 72 slidably encage guide holes 74 formed in the support arms 70.

The piston 14 indicated above includes a neck portion 80 engaging the swash plate 60, a head portion 82 fitted in the corresponding cylinder bore 12, and a connecting portion 83 connecting the neck and head portions 80, 82. The neck portion 80 has a groove 84 formed therein, and the swash plate 60 is held in engagement with the groove 84 through a pair of hemi-spherical shoes 86. The hemi-spherical shoes 86 are held in the groove 84 at their hemi-spherical surfaces such that the shoes 86 slidably engage the neck portion 80 at their hemi-spherical surfaces, and slidably engage the opposite surfaces of the swash plate 60 at their flat surfaces. It will be understood that the piston 14 according to the present embodiment is a single-headed piston. The head portion 82 of the piston 14 cooperates with the cylinder block 10 and the valve plate structure 20 to define a pressurizing chamber 87. The configuration of the piston 14 will be described in detail.

A rotary motion of the swash plate 60 is converted into a reciprocating linear motion of the piston 14 through the shoes 86. A refrigerant gas in the suction chamber 22 is sucked or admitted into the pressurizing chamber 87 through the suction port 40 and the suction valve 42, when the piston 14 is moved from its upper dead point to its lower dead point, that is, when the piston 14 is in the suction stroke. The refrigerant gas in the pressurizing chamber 87 is pressurized by the piston 14 when the piston 14 is moved from its lower dead point to its upper dead point, that is, when the piston 14 is in the compression stroke. The thus pressurized refrigerant gas is delivered into the discharge chamber 24 through the discharge port 46 and the discharge valve 48. A reaction force acts on the piston 14 in the axial direction as a result of compression of the refrigerant gas in the pressurizing chamber 87. This compression reaction force is received by the front housing 16 through the piston 14, swash plate 60, lug plate 62 and the thrust bearing 66.

As shown in FIG. 2, the neck portion 80 of the piston 14 has an integrally formed rotation preventive portion 88, which is arranged to contact the inner circumferential surface of the front housing 16, for thereby preventing a rotary motion of the piston 14 about its centerline N (FIG. 1).

The cylinder block 10 has an intake passage 94 formed therethrough for communication between the discharge chamber 24 and a crank chamber 96 which is defined between the front housing 16 and the cylinder block 10. The intake passage 94 is connected to a solenoid-operated control valve 100 provided to control the pressure in the crank chamber 96. The solenoid-operated control valve 100 includes a solenoid coil 102, and a shut-off valve 104 which is selectively closed and opened by energization and de-energization of the solenoid coil 102. Namely, the shut-off valve 104 is placed in its closed state when the solenoid coil 102 is energized, and is placed in its open state when the coil 102 is de-energized.

The rotary drive shaft 50 has a bleeding passage 110 formed therethrough. The bleeding passage 110 is open at one of its opposite ends to the central support hole 56 indicated above, and is open to the crank chamber 96 through a communication passage 112. The central support hole 56 communicates at its bottom with the suction chamber 22 through a communication port 114.

When the solenoid coil 102 of the solenoid-operated control valve 100 is energized, the intake passage 94 is closed, so that the pressurized refrigerant gas in the discharge chamber 24 is not delivered into the crank chamber 96. In this condition, the refrigerant gas in the crank chamber 96 flows into the suction chamber 22 through the exhaust passage 110 and the exhaust port 114, so that the pressure in the crank chamber 96 is lowered. As a result, the angle of inclination of the swash plate 60 with respect to a plane perpendicular the axis of rotation M of the drive shaft 50 is increased, and the discharge capacity of the compressor is accordingly increased.

When the solenoid coil 102 is de-energized, the intake passage 94 is opened, permitting the pressurized refrigerant gas to be delivered from the discharge chamber 24 into the crank chamber 96, resulting in an increase in the pressure in the crank chamber 96, and the angle of inclination of the swash plate 60 is reduced, so that the discharge capacity of the compressor is accordingly reduced.

The maximum angle of inclination of the swash plate 60 is limited by abutting contact of a stop 120 formed on the swash plate 60, with the lug plate 62, and the minimum angle of inclination of the swash plate 60 is limited by abutting contact of the swash plate 60 with a stop 122 in the form of a ring fixed to the drive shaft 50.

As described above, the pressure in the crank chamber 96 is controlled by controlling the solenoid-operated control valve 100 to selectively connect and disconnect the crank chamber 96 to and from the discharge chamber 24. The angle of inclination of the swash plate 60 is changed with a change in the pressure in the crank chamber 96, so that the stroke of the piston 14 is controlled to control the discharge capacity of the compressor. Thus, the swash plate type compressor having the piston 14 in each cylinder bore 12 is of a variable capacity type. The solenoid coil 102 of the solenoid-operated control valve 100 is controlled by a control device (not shown) depending upon a load acting on the air conditioning system including the present compressor. The control device is principally constituted by a computer.

The cylinder block 10 and each piston 14 are formed of an aluminum alloy. The piston 14 is coated at its outer circumferential surface with a fluoro resin film, which prevents a direct contact of the aluminum alloy of the piston 14 with the aluminum alloy of the cylinder block 10, and makes it possible to minimize the amount of clearance between the piston 14 and the cylinder bore 12. The cylinder block 10 and the piston 14 may also be formed of a hyper-eutectic aluminum silicon alloy. Other materials may be used for the cylinder block 10 and the piston 14.

There will next be described the configuration of the piston 14.

As shown in FIGS. 2 and 3, the head portion 83 of the piston 14 includes a body portion 128, and an outer sliding projection 130 and an inner sliding projection 132 which correspond to respective radially outer and inner portions of the cylinder block 10. The body portion 128 has a circular shape in cross section. The outer and inner sliding projections 130, 132 project toward the neck portion 80 from respective circumferential parts of the circular body portion 128, which parts correspond to the radially outer and inner portions of the cylinder block 10. The outer and inner sliding projections 130, 132 are adapted to slide on the respective circumferential portions of the inner circumferential surface of the cylinder bore 12, which portions correspond to the radially outer and inner portions of the cylinder block 10.

The inner sliding projection 132, which has a sliding surface 133, is located at the circumferential portion of the piston 14 in which the groove 84 formed in the neck portion 80 is open. This circumferential portion of the piston 14 will be referred to as "radially inner circumferential portion", and the circumferential portion of the piston 14 diametrically opposite to the radially inner circumferential portion will be referred to as "radially outer circumferential portion".

The connecting portion 82 of the piston 14 includes a rib 135 connecting the inner sliding projection 132 and the neck portion 80. Namely, the head portion 82 and the neck portion 80 are connected to each other by the connecting portion 83 at the radially inner circumferential portion of the piston 14, but are not connected to each other at the other circumferential portions of the piston 14 including the radially outer circumferential portion. This arrangement permits a considerable reduction in the weight of the piston 14.

From the standpoint of the required strength of the piston 14, the head portion 82 and the neck portion 80 need not be connected to each other at both of the radially inner and outer circumferential portions of the piston 14. The elimination of the connecting portion 83 at the radially outer circumferential portion of the piston 14 is effective to reduce the weight of the piston 14. This elimination may require an increase in the weight of the connecting portion 83 at the radially inner circumferential portion of the piston 14, to obtain the required strength of the connecting portion 83. However, the provision of the connecting portion 83 at the radially inner circumferential portion only permits a reduced weight of the piston 14, as compared with the provision of the connecting portion at both of the radially inner and outer circumferential portions.

In the present first embodiment, the rib 135 is inclined with respect to the centerline N of the piston 14, in order to increase the strength of the connecting portion 83. Namely, the rib 135 is formed so as to extend generally in the direction in which the piston 14 receives a reaction force from the swash plate 60, rather than in the direction parallel to the centerline N, so that the strength of the connecting portion 83 is effectively increased.

In the present embodiment, the inner sliding projection 132 is configured such that the sliding surface 133 of the projection 132 is symmetrical with respect to a plane which includes the centerline N of the piston 14 and the centerline M of the cylinder block 10 (axis of rotation M of the drive shaft 50). This configuration permits the inner sliding projection 132 to receive the reaction force from the cylinder bore 12 over a sufficiently large surface area, irrespective whether the drive shaft 50 is rotated in the clockwise or counterclockwise direction. Accordingly, the instant configuration is effective to minimize a local wear of the inner sliding projection 132 and the cylinder bore 12. Where the drive shaft 50 is always rotated in the predetermined direction (clockwise or counterclockwise), the weight of the inner sliding projection 132 may be reduced at its trailing portion as seen in the rotating direction of the drive shaft 50, in order to reduce the weight of the piston 14. In this case, however, the piston 14 can be used for only a swash plate type compressor wherein the drive shaft 50 is always rotated in the predetermined direction. In this respect, the present piston 14 can be used irrespective of the direction of rotation of the drive shaft 50.

Figure 5:
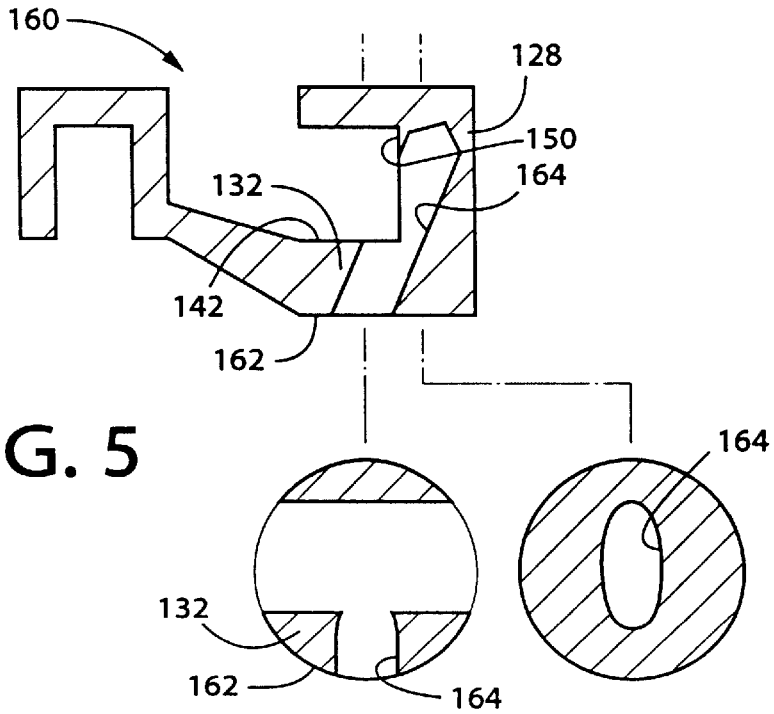
FIG. 5 is a cross sectional view of a piston according to a further embodiment of the invention.
Figure 6:
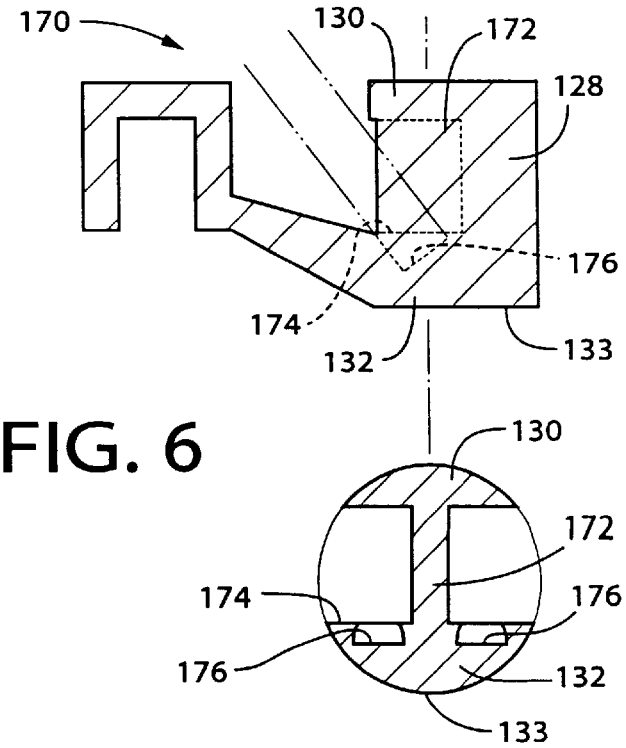
FIG. 6 is a cross sectional view of a piston according to a still further embodiment of the invention.

The configuration of the piston 14 is not limited to that described above, and may be designed otherwise. For instance, pistons 140, 160 and 170 as shown in FIGS. 4, 5 and 6 are provided according to other embodiments of this invention.

Figure 4:
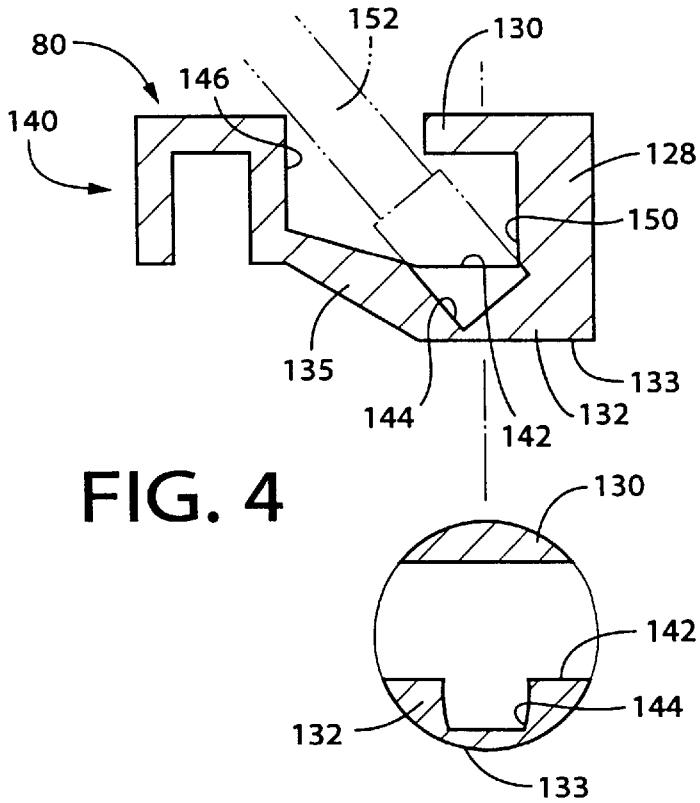
FIG. 4 is a cross sectional view of a piston according to another embodiment of this invention.

In the piston 140 of FIG. 4, the inner sliding projection 132 has a recess 144 in an inner surface 142 thereof which faces in the radially outward direction of the cylinder block 10 and which is opposed to the outer sliding projection 130. As in the piston 14 of the first embodiment of FIGS. 2 and 3, an opening 146 is provided between the outer sliding projection 130 and the neck portion 80, which are not connected by the connecting portion including the rib 135. The inner surface 142 can be easily accessed through the opening 146 when the recess 144 is formed in the inner surface 142.

In the present second embodiment wherein the piston 14 is formed by casting, the recess 144 is formed by a cutting operation using a cutting tool 152 such as an end mill, with the cutting tool 152 extending through the opening 146, after the casting of the piston 14. Described in detail, the rotating cutting tool 152 extending through the opening 146 and the piston 14 are fed relative to each other, with the cutting edge of the tool 152 being held in contact with the inner surface 142. In the present embodiment, the rotating end mill 152 is fed relative to the inner surface 142. The provision of the recess 144 provides a further reduction in the weight of the piston 14.

It is also noted that the recess 144 also functions as an oil reservoir. A lubricating oil distributed in the crank chamber 96 is accumulated in the oil reservoir 144, and is splashed upon reciprocating motion of the piston 14, to lubricate the contacting surfaces of the piston 14 and the cylinder bore 12, and the contacting surfaces of the piston 14 and the swash plate 60, so that the sliding resistance of the piston 14 is effectively reduced for smooth sliding motion of the piston 14.

The piston 140 may be produced by casting with the recess 144 formed in the inner surface 142. A slide core used for forming the recess 144 during casting of the piston 140 can be easily set in a casting mold, through an opening of the mold corresponding to the opening 146.

While the single recess 144 is formed in the inner surface 142, a plurality of recesses may be formed in the inner surface 142. The at least one recess formed in the surface 142 may be shaped and dimensioned as desired. To minimize the weight of the piston 14, the total volume of the at least one recess is desirably maximized to such an extent that assures the sufficient strength of the piston 14.

Further, at least one recess may also be formed in an inner surface 150 of the body portion 128 which faces toward the neck portion 80. The provision of the recesses in both of the inner surfaces 142, 150 provides a further reduction in the weight of the piston 14. The inner surface 150 rather than the inner surface 142 may have at least one recess.

In the piston 160 of FIG. 5, a recess in the form of a hole 164 is formed, with a suitable cutting tool such as a drill, in the inner sliding projection 132 and the body portion 128, such that the hole 164 is open in the side of an outer sliding surface 162 of the inner sliding projection 132 which slidably contacts the inner circumferential surface of the cylinder bore 12. In this third embodiment, the hole 164 is formed obliquely with the cutting tool being fed through the inner sliding projection 132 until the cutting tip of the tool reaches a midpoint of the thickness of the body portion 128. Although the hole 164 is open in the outer sliding surface 162 of the inner sliding projection 132, a fluid-tight sealing is provided between the sliding surface of the body portion 128 and the inner circumferential surface of the cylinder bore 12.

While the hole 164 may be formed at any part of the inner sliding projection 132, it is desirable to form the hole 164 at a part at which the reaction force received by the projection 132 is not so large. The reaction force is relatively large at the end portion of the projection 132 on the side of the neck portion 80, and at the circumferential portion of the projection 132 which is on the leading side of the plane including the centerlines N and M of the piston 160 and cylinder block 10, as seen in the rotating direction of the drive shaft 50. In this respect, the hole 164 is preferably located at a portion of the projection 132 other than the above-indicated portion at which the reaction force is relatively large. In the present embodiment, the hole 164 is formed through an intermediate portion of the projection 132 (open in an intermediate portion of the sliding surface 162), as viewed in the axial direction of the drive shaft 50. For instance, the hole 164 may be formed by feeding a rotating drill through the projection 132 and the body portion 128 of the stationary piston 160, such that the hole 164 is open in the sliding surface 162.

The hole 164 extending through the inner sliding projection 132 need not reach the body portion 128. Further, a plurality of holes may be formed, provided none of the holes are located at the above-identified end portion of the projection 132 at which the reaction force is relatively large. In any case, at least one hole is effective to reduce the weight of the piston 160. It is also noted that at least one recess is formed in at least one of the inner surfaces 142, 150, while at the same time at least one recess is formed in the outer sliding surface 162. For instance, the recess 144 shown in FIG. 4 is formed in the inner surface 142 while the hole 164 shown in FIG. 5 is formed in the outer sliding surface 162. In this case, the weight of the piston can be further reduced. Further, at least one recess may be formed in at least one of the inner surfaces 142, 150 and outer sliding surface 162, in the piston 14 of FIG. 3 and any other piston having a rib which connect the head portion 82 and the neck portion 80 at the radially inner circumferential portion of the piston.

The piston 170 of FIG. 6 has a wall 172 which extends in the radial direction of the drive shaft 50. The wall 172 is provided between the outer and inner sliding projections 130, 132. In this fourth embodiment, the wall 172 connects the outer and inner sliding projections 130, 132, for increasing the strength of the piston 170 and thereby minimizing a local wear of the piston 170. The wall 172 may be formed so as to extend in a direction intersecting the circumferential direction of the circular body portion 128. The inner sliding projection 132 has two recesses 176 in an inner surface 174 thereof which is opposed to the outer sliding projection 130. The two recesses 176 are located on the respective opposite sides of the wall 172. Each recess 176 may be formed in the same manner as in the second embodiment. Like the recess 144, the recesses 176 function as an oil reservoir.

The piston 170 may have a plurality of walls 172 to further increase its strength. It is noted that at least one wall 172 need not connect the outer and inner sliding projections 130, 132. For instance, the wall 172 may extend from the inner sliding projection 132 toward the outer sliding projection 130, or alternatively, from the outer sliding projection 130 toward the inner sliding projection 132.

The construction of the swash plate type compressor for which the piston 14, 140, 160, 170 is incorporated is not limited to that of FIG. 1. For example, the solenoid-operated control valve 100 is not essential, and the compressor may use a shut-off valve which is opened and closed on the basis of a difference between the pressures in the crank chamber 96 and the suction chamber 24. The control valve 100 or the shut-off valve permits an increase in the discharge capacity of the compressor with a decrease in the pressure in the crank chamber 96 which causes an increase in the angle of inclination of the swash plate 60.

It is to be understood that the present invention is not limited to the details of the illustrated embodiments and the various forms of the invention described in the SUMMARY OF THE INVENTION, but may be otherwise embodied.

What is claimed is:

1. A piston for a swash plate type compressor, including a head portion slidably fitted in a cylinder bore formed in a cylinder block of the compressor, a neck portion slidably engaging a swash plate of the compressor, and a connecting portion connecting said head and neck portions, wherein an improvement comprises:

said head portion comprising a body portion having a circular shape in cross section, and an inner sliding projection extending toward said neck portion from a radially inner circumferential part of said body portion which corresponds to a radially inner portion of said cylinder block, said inner sliding projection having a sliding surface for sliding contact with an inner circumferential surface of said cylinder bore, said sliding surface being symmetrical with respect to a plane including a centerline of said piston and a centerline of said cylinder block, said connecting portion connecting said inner sliding projection and said neck portion, at said radially inner circumferential part of said body portion, and not connecting said head portion and said neck portion at a radially outer circumferential part of said body portion which corresponds to a radially outer portion of said cylinder block.

2. A piston according to claim 1, wherein at least one of a first inner surface of said inner sliding projection which faces in a radially outward direction of said cylinder block and a second inner surface of said body portion which faces toward said neck portion has at least one recess formed therein.

3. A piston according to claim 2, wherein said at least one recess includes at least one recess open in said sliding surface of said inner sliding projection.

4. A piston according to claim 1, wherein said head portion comprises at least one of (a) an outer sliding projection extending toward said neck portion from a radially outer circumferential part of said body portion which corresponds to a radially outer portion of said cylinder block, said outer sliding projection having a sliding surface for sliding contact with said inner circumferential surface of said cylinder bore, and (b) a wall extending in a direction which intersects a circumferential direction of said body portion.

5. A piston for a swash plate type compressor, including a head portion slidably fitted in a cylinder bore formed in a cylinder block of the compressor, a neck portion slidably engaging a swash plate of the compressor, and a connecting portion connecting said head and neck portions, wherein an improvement comprises:

said head portion comprising a body portion having a circular shape in cross section, and an inner sliding projection extending toward said neck portion from a radially inner circumferential part of said body portion which corresponds to a radially inner portion of said cylinder block, said inner sliding projection having a sliding surface for sliding contact with an inner circumferential surface of said cylinder bore, said inner sliding projection having at least one recess open in said sliding surface.

6. A swash plate type compressor comprising:

a cylinder block having a plurality of cylinder bores arranged along a circle;

a rotary drive shaft having an axis aligned with a centerline of said circle;

a swash plate rotated by said drive shaft; and a piston including a head portion slidably fitted in each of said cylinder bores, a neck portion slidably engaging said swash plate, and a connecting portion connecting said head and neck portions, said piston being reciprocated by rotation of said swash plate by said drive shaft, said head portion comprising a body portion having a circular shape in cross section, and an inner sliding projection extending toward said neck portion from a radially inner circumferential part of said body portion which corresponds to a radially inner portion of said cylinder block, said inner sliding projection having a sliding surface for sliding contact with an inner circumferential surface of said cylinder bore, said sliding surface being symmetrical with respect to a plane including a centerline of said piston and a centerline of said cylinder block, said connecting portion connecting said inner sliding projection and said neck portion, at said radially inner circumferential part of said body portion, and not connecting said head portion and said neck portion at a radially outer circumferential part of said body portion which corresponds to a radially outer portion of said cylinder block.

7. A swash plate type compressor comprising:

a cylinder block having a plurality of cylinder bores arranged along a circle;

a rotary drive shaft having an axis aligned with a centerline of said circle;

a swash plate rotated by said drive shaft; and a piston including a head portion slidably fitted in each of said cylinder bores, a neck portion slidably engaging said swash plate, and a connecting portion connecting said head and neck portions, said piston being reciprocated by rotation of said swash plate by said drive shaft, said head portion comprises a body portion having a circular shape in cross section, and an inner sliding projection extending toward said neck portion from a radially inner circumferential part of said body portion which corresponds to a radially inner portion of said cylinder block, said inner sliding projection having a sliding surface for sliding contact with an inner circumferential surface of said cylinder bore, said inner sliding projection having at least one recess open in said sliding surface.

* * * * *